United States Patent [19]

Völkl et al.

[11] 4,431,209

[45] Feb. 14, 1984

[54] SKI

[75] Inventors: Franz Völkl; Heinz Müller, both of Straubing, Fed. Rep. of Germany

[73] Assignee: Franz Völkl OHG, Straubing, Fed. Rep. of Germany

[21] Appl. No.: 230,592

[22] Filed: Feb. 2, 1981

[30] Foreign Application Priority Data

Feb. 12, 1980 [DE] Fed. Rep. of Germany ..... 3005171

[51] Int. Cl.[3] ..... A63C 7/06

[52] U.S. Cl. ..... 280/604

[58] Field of Search ..... 280/604, 608, 609, 610; 76/83; 51/205 WG, 206 R, 228; 428/112; 264/162

[56] References Cited

U.S. PATENT DOCUMENTS

| | | | |
|---|---|---|---|
| 2,142,459 | 1/1939 | Sahy | 280/604 |
| 3,146,560 | 9/1964 | Hurst | 51/206 R X |
| 3,858,894 | 1/1975 | Ver et al. | 280/604 |
| 4,118,050 | 10/1978 | Schnurrenberger | 280/604 |
| 4,178,012 | 12/1979 | Roth et al. | 280/604 |
| 4,223,909 | 9/1980 | Danner et al. | 280/604 |
| 4,272,577 | 6/1981 | Lyng | 280/604 X |

FOREIGN PATENT DOCUMENTS

| | | | |
|---|---|---|---|
| 33864 | 8/1981 | European Pat. Off. | 280/604 |
| 720609 | 5/1942 | Fed. Rep. of Germany | 280/604 |
| 2934309 | 3/1980 | Fed. Rep. of Germany | 280/604 |
| 808359 | 11/1936 | France | 280/604 |
| 2269359 | 11/1975 | France | 280/604 |

*Primary Examiner*—Joseph F. Peters, Jr.
*Assistant Examiner*—Mitchell J. Hill
*Attorney, Agent, or Firm*—Michael J. Striker

[57] ABSTRACT

A ski has an elongated body part, a polyethylene bottom layer arranged on the body part, and a roughening provided on a sliding surface of the bottom layer over a supporting length of the ski and including a plurality of projections each formed as an elongated tooth from polyethylene of the bottom layer and inclined in its entirety toward the rear end of the body part, wherein the teeth are arranged with a density of between 1000 and 4000 teeth per $cm^2$. The inventive ski is manufactured by dry grinding of the sliding surface of the polyethylene bottom layer with a relatively high efficiency.

19 Claims, 4 Drawing Figures

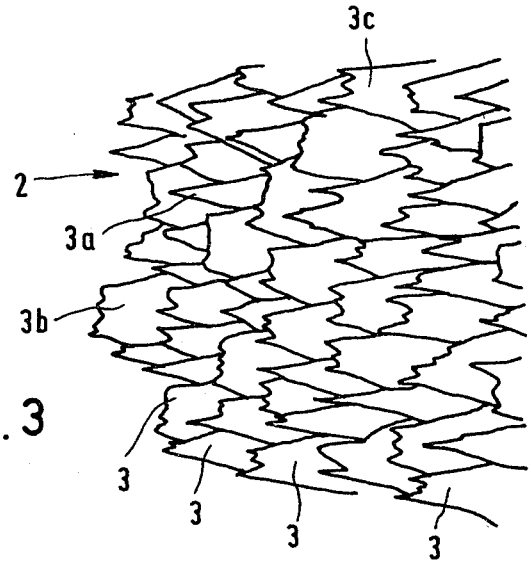
FIG. 3
FIG. 1
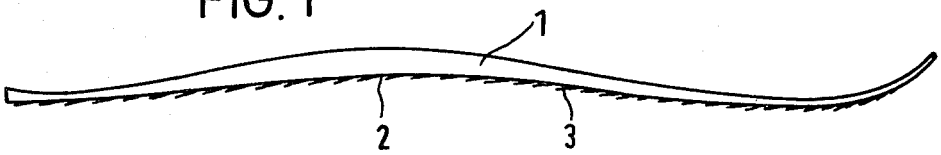
FIG. 2
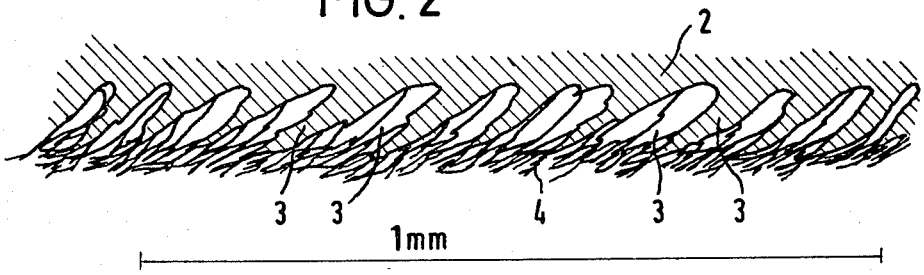
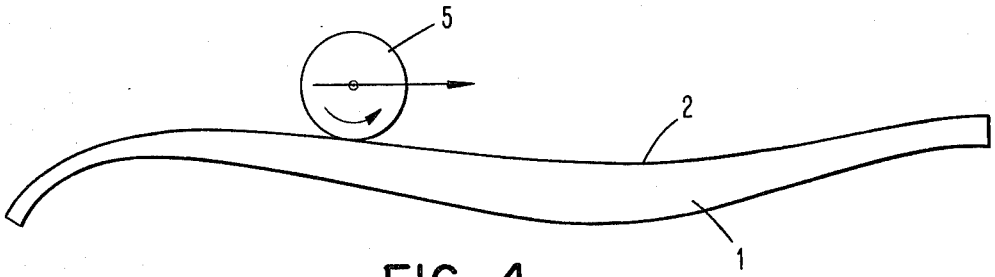
FIG. 4

SKI

BACKGROUND OF THE INVENTION

The present invention relates to a Ski with Roughened Sliding Surface, particularly a cross-country ski, which has a polyethylene bottom layer with a roughened sliding surface.

Skis of the above-mentioned general type are known in the art. A known ski has a roughening on the sliding surface of the polyethylene bottom layer, which makes easier climbing of the ski and only insignificantly influences the sliding of the same. The roughening is composed of small projections which have a thickness substantially corresponding to $10^{-1}$ and their portions which are spaced from the ski are inclined toward the rear end of the latter. The above-mentioned thickness is the distance between the soles of the valleys between the individual projections of the roughening, and the distance between the peaks of the projections from the above-mentioned soles. In view of the fact that in practice the roughening has certain non-uniformities, the level of the soles and the level of the peaks are calculated as mean values. The expression that the projections with their portions remote from the ski are inclined toward the ski rear end also includes such a situation when some projections do not have such an inclination, as soon as the number of the projections which do not have the inclination is insignificantly small as considered with the number of the projections which do have the inclination. Order of values here means the order of value corresponding to the ten power; and the limit of the order of magnitude relative to the next greater one and the next smaller one is performed exponentially, for example the order of value $10^x$ includes the region from $10^{(x-\frac{1}{2})}$ to $10^{(x+\frac{1}{2})}$. This region can also be easily defined in that it extends between one-third of the indicated ten power to substantially three times the same. In the known ski, the roughening is composed of grooves which extend transverse to the direction of elongation of the ski. The roughening has respectively a structure which is formed by a plurality of neighboring ribs and valleys alternating with and merging into one another, having more or less sharp edges, and extending transverse to the direction of elongation of the ski. In the region of the tips, the ribs are fuzzed and inclined toward the ski rear end under the action of a subsequent treatment. The above inclination to the rear end of the ski is insignificant in the known skis. Since the roughened region of the known ski is provided only under the binding region and extends in direction of elongation of the ski only over a portion between one-third and one-fifth of the same, such skis, because of the obtained flake profile, are advantageous as compared with other skis since they provide for help in pushing off, and also improve the safety against rearward sliding during climbing at least in condition of icy runways. The increased friction resistance in the central region of the ski is not very disturbing, inasmuch as during sliding the weight of the skier is not completely applied to the individual ski. During pushing off and climbing in the respective phase, the weight of the skier is applied fully to the ski, and the ski is pressed with its central upwardly curved part downwardly into the snow, so that the transverse profiling engages stronger with the latter.

Another ski has a bottom layer of synthetic plastic material, such as polyester, epoxide-polyurethane resin or phenol resin, and a plush-like textile fabric is embedded in the layer so that the fibers of the fabric extend at least to the sliding surface of the bottom layer. The extending fabric fibers can have in the end regions a small curvature toward the rear ski end. The extension of the tips of the fibers outwardly beyond the sliding surface must be obtained by grinding of the sliding surface of the bottom layer. Thereby the textile fibers can extend outwardly beyond the sliding surface of the bottom layer by a distance of up to 1 mm. Such a construction is rarely utilized in practice. During grinding of the sliding surface of the synthetic plastic layer, the threads of the embedded fabric do not remain standing, but instead they are ground off. When a fabric of a considerable hard material is selected for the bottom layer, the above-mentioned extension of the fiber ends outwardly of the sliding face of the bottom layer can be attained by grinding. However, the hard fibers possess low sliding characteristics and hinder the sliding of the ski forwardly in the event when their extension is sufficient to help in pushing off or climbing. Further, ice tends to set on such bottom layers in the hard region very easily. Moreover, the embedding of the fabric having a nap in a very thin synthetic plastic layer serving as a ski bottom encounters considerable technical difficulties, particularly when it is necessary to provide that the threads of the nap at least with their tips have a uniform inclination in a predetermined direction. Thereby, this solution is not practically utilized because of the above-mentioned considerations.

SUMMARY OF THE INVENTION

Accordingly, it is an object of the present invention to provide a ski which avoids the disadvantages of the prior art.

More particularly, it is an object of the present invention to provide a ski which has a considerably improved climbing ability, that is the resistance of the ski against rearward sliding during climbing or pushing off, and at the same time has high sliding characteristics.

Still another feature of the present invention is to provide a ski in which the above-mentioned improved climbing ability can be attained with small technical expenses and in simple reproducible manner.

In keeping with these objects and with others which will become apparent hereinafter, one feature of the present invention resides, briefly stated, in a ski which has an elongated body part with a polyethylene bottom layer having a roughening on a sliding surface of the layer, wherein the roughening extends substantially over the entire supporting length of the ski and includes projections which are formed as elongated teeth from the polyethylene of the layer, inclined in their entirety toward the rear end of the body part and arranged with a density of between 1000 and 4000 teeth per square centimeter.

In contrast to the above-described previously known skis, the roughening in accordance with the present invention is not formed as transverse ribs with rearwardly bend ridges. Contrary to this, the roughening includes a plurality of randomly arranged teeth each inclined in its entirety towards the rear end of the ski. In contrast to the above mentioned other ski, in which the threads of the textile fabric extend outwardly beyond the sliding surface of the layer, the projections of the roughening in accordance with the present invention is constituted of the same sliding material from which the bottom layer of the ski is constituted. Moreover, the projections of the inventive ski do not have the shape of short fiber or filament ends, but they have the shape of teeth. They can be inclined considerably stronger to the plane of the bottom layer toward the rear end of the ski than the threads of a fabric can be inclined.

The teeth of the inventive ski are projections of a small thickness which reduce from their initial portion on the bottom layer to their free ends, and the free ends can be formed as pointed tips or cutting edges having several prongs or being throughgoing edges. When the teeth have a cutting edge, the cutting edge or its central portion extends at least over the major part of the teeth considerably transverse to the direction of elongation of the ski and parallel to the sliding surface of the bottom layer. It is to be understood that the cutting edges of almost all teeth face towards the rear end of the ski. The cutting edges of the teeth frequently extend in tongue-like and fuzzed manner, whereas the tongue-like portions may also be wave-shaped.

The teeth in accordance with the invention have very small dimensions. When the thickness of the layer which is formed by the teeth determining the roughening is selected in the region of order of value of $10^{-1}$, it is advantageous when the thickness is between 0.06 mm and 0.1 mm. Experience shows that the best results are obtained when the thickness is of substantially 0.08 mm.

The teeth must be arranged with a sufficient density so as to prevent sliding of the ski in the flat region between the individual teeth and to guarantee that each tooth plows through the snow. Advantageously the teeth are arranged so dense that they overlap one another like the hairs of a smooth fur or the scales of a fish and cover the bottom ski layer. Since the teeth are constituted of the same material of which the bottom layer is constituted, namely of polyethylene which subsequently will be identified as PE, they have the advantageous sliding characteristics of this material and do not undesirably affect forward sliding of the ski more than a smooth PE bottom layer. It is to be understood that the term "polyethylene" also includes equivalent synthetic plastic materials with similar sliding characteristics. They must have easy workability and be also thermoplastic. Nowadays polyethylene which is generally utilized as a ski bottom layer, is a material which is utilized for the bottom layer in accordance with the present invention.

The teeth may have different shapes. It is advantageous when the teeth in the longitudinal section of the ski have a shark-tooth-like or wolf-tooth-like profile. These profiles forms the basic shape of the teeth. Naturally, unevenness of the sliding surface or substantial bifurcation of a tooth and similar variations are permissible. The desired shape of the teeth may be described in the simplest manner as the shape of flat cutting teeth and slim splitting teeth.

The teeth in accordance with the present invention may be fuzzed and frayed at their tips or free edges. This construction can be obtained by an advantageous method of manufacture of the inventive ski which will be described below. A part of the fuzz drifts relatively fast just after the beginning of the utilization of the ski. After the wearing of the sliding surface because of intensive utilization and running over ground particles embedded in snow, the sliding surface restored with the provision of the desired teeth thereon.

The length of the projections must be so great that the teeth, as shown by experiments, during rearward sliding of the ski spread into the snow. However, they must not be so great that in condition of excessively long teeth they can bend in undesirable manner. Advantageously, the length of the teeth is considerably greater than their thickness in direction of elongation of the ski. The length of a tooth is equal to the length of the tooth's central line in the longitudinal cross-section of the ski between the plane from which the field of the tooth rises and the tip of the tooth, wherein the fuzz on the tip of the tooth is not taken into consideration.

The central cross-sectional area of the teeth is equal first of all in the region substantially from 0.003 and 0.001 $mm^2$. The central cross-section of a tooth means here a cross-section extending through a central longitudinal plane normal to its centerline. The average length of the teeth is advantageously equal to substantially between 0.08 and 0.3 mm; the length of the individual teeth cannot considerably deviate from this value. The mean inclination of the teeth to the plane of the sliding surface of the ski is advantageously equal to between substantially 20° and 50°, preferably is equal to substantially 35°. The lower portion of the above-mentioned region is preferable. The inclination of the teeth tips can be even more stronger. The stronger is the inclination, the smaller is the sliding resistance. The inclination of the teeth tips can be below 0°. The teeth are advantageously arranged with a density of substantially between 10 and 40 teeth, preferably 10–25 teeth, per $mm^2$ of the sliding surface. Normally the individual teeth cannot be recognized with the naked eye. In many cases, the teeth can be recognized by hand moving over the sliding surface in sliding direction and in the opposite direction, as increased resistance during moving in the opposite direction.

It has been shown from practical experiments that high sliding and climbing properties of the bottom layer can be attained when at least the teeth of the bottom layer are constituted of high molecular polyethylene. Advantageously, the entire bottom layer is constituted of this material. The polyethylene is advantageously sintered and/or compressed polyethylene. The molecular weight of the polyethylene is equal advantageously to between $1\times10^6$ to $4\times10^6$, preferably between $2\times10^6$ and $3\times10^6$. A suitable polyethylene is, for example, a polyethylene of Hö chst AG under the name of "Hostalen GUR" (trademark protected in U.S.A.).

The thickness of the roughening is advantageously equal to substantially between 0.03 and 0.08 mm, preferably 0.04–0.07 mm. The ski with a thickness of 0.04–0.06 mm is proved by experience to have good qualities.

Since in accordance with the present invention the sliding resistance during forward sliding of the ski is extremely low, it is no longer necessary to arrange the projections only in the central region or in the region of the binding of the ski. Thereby in accordance with the invention the entire supporting length of the ski is provided with the roughening formed by the aforedescribed teeth.

This provides for a considerable advantage of the invention, in the sense of both the sliding characteristics and the manufacture of the ski. In addition, the elasticity of the ski must no longer be particularly determined by the weight of the skier. This also provides for a considerable advantage for the manufacturing of the ski. The expression "supporting length of the ski" is intended to cover practically the whole length of the ski except the upwardly bent tip part of the ski. In the best way, the entire supporting length of the ski is roughened. It is also possible to provide small interruptions in the roughening. The roughened region can be reduced at the ends of the supporting length of the ski. In lateral direction, the roughening extends over the entire width of the ski, whereas it is advantageous when the guiding grooves in the center of the ski remain smooth.

It is essential for the present invention that the entire layer of the teeth forms a closed outer sliding surface which offers only a small shape resistance to the foward sliding. The low value of this small friction resistance is obtained because of the non-uniform and ragged tips of the teeth, since they have higher flexibility and lie easily in the plane of the layer outer surface and at the same time do not prevent a braking spreading of the teeth into the snow during the rearward sliding.

The ski according to the present invention operate without waxing, particularly in condition of high temperatures. For temperatures below 273° K. (0° C.), they can advantageously be waxed with liquid wax with paraffin base. Thereby ice covering up and snow settling on the ski is prevented and simultaneously the sliding characteristic of the ski is improved without undesirably affecting the climbing properties of the same. In condition of the temperatures in the region over about 273° K. (0° C.), such waxing is as as rule not necessary.

Another feature of the present invention is a method of manufacturing of the ski in accordance with the present invention. The method includes forming on the sliding surface of the polyethylene bottom layer of the ski, a roughening by grinding of the layer, so that the roughening extends over a distance substantially corresponding to the entire supporting length of the ski and includes a plurality of projections each formed as an elongated tooth from the polyethylene of the layer and inclined in its entirety toward the rear end of the body part, whereas the teeth are arranged with the density of between 1000 and 4000 teeth per $cm^2$. The grinding is performed as dry grinding with a coarse grinding wheel so as to provide a grinding finish which is symmetrical relative to the plane of symmetry of the ski. The bottom layer constituted of high molecular, preferably sintered PE is ground with an extremely high grinding efficiency so as to provide on the sliding surface of the layer, a crystallite melted region. Such a method makes possible the manufacture of the inventive roughened sliding surface in an extremely simple and inexpensive manner. The grinding efficiency means here the work performed for grinding of the sliding surface of the bottom layer per unit time and unit area in form of material-removing work converted into heat.

Since in accordance with the present invention the above-mentioned crystallite melting region is attained, the sliding surface, at least in the event of the utilization of high molecular polyethylene, has no longer a normal grinding structure as in the skis manufactured, in a usual manner. In contrast, it has a plurality of fine projections on the sliding surface which is principally cutting edge-shaped or splitting-tooth-shaped. The attainment of the proper temperature region can be recognized by drawing of the individual teeth to long fibers.

The grinding efficiency of the bottom layer per unit area depends, first of all, on the pressing force with which the ski is pressed against the grinding tool or the grinding tool is pressed against the ski, on the grinding speed of the grinding tool, and on the feeding speed with which the ski is fed against the grinding tool. When the method is performed with proper parameters, a special cooling is not required inasmuch as not inconsiderable heat which is generated during the inventive process is utilized for obtaining of the special structure of the sliding surface.

It has been proven advantageous when the grinding is performed with a pressure of the grinding wheel against the sliding surface of the bottom layer of the ski of between 0.5 and 7 bar. This pressure is many times greater than the pressure which is utilized for grinding in usual grinding process. This is attained by the fact that the grinding wheel abuts with a certain part of its periphery against the ski. This part of the periphery results from the thickness of the polyethylene layer which is loosened during the grinding of a teeth field and the diameter of the grinding wheel. The surface onto which the pressing force acts for generation of the pressure is an arcuate surface abutting against the grinding wheel, located between the flat not worked sliding surface of the bottom layer and principally similarly flat worked surface from which teeth raises after the grinding. The above-mentioned arcuate face which is in engagement with the grinding wheel is a theoretically calculated surface, inasmuch as in practice an exact determination of the pressure is impossible because of the roughness of the grinding wheel and the non-uniformity of other essential factors. Advantageously, the grinding is performed in two steps. A first grinding step is performed with the pressure of between 5.5 and 7 bar, whereas the second grinding step is performed with the pressure of between 0.7 and 0.8 bar.

Good results have been obtained in practice when the grinding is performed by grinding wheels which have the graininess 30 from medium to high porosity, and medium hardness, and are pressed against a cross-country ski of a medium width substantially equal to 5 cm with a force of between 30 and 250 N, preferably 50–200 N. The diameter of the grinding wheel is 350 mm. During the first grinding step, the force is equal to substantially 200 N, and during the second grinding step it is equal to substantially 50 N.

It has been shown that it is advantageous to perform the grinding with the grinding speed of between 300 and 2000 m/min. Good results are attained with the grinding speed between 450 and 1600 m/min. The feeding of the skis is performed advantageously with a speed of between 1 and 4 m/min. Good results are obtained with the feeding speed in the region of substantially 2 m/min.

The grinding is performed advantageously in the direction of elongation of the ski. However, in many cases it is advantageous when the grinding is performed in a direction which includes an acute angle with the direction of elongation of the ski. The acute angle may be actually acute and advantageously equal to less than 45°. Since the grinding is always performed symmetrically to the plane of symmetry of the ski in order to avoid a tendency to lateral displacement of the same, the grinding finish during grinding at an angle to the direction of elongation of the ski must always have a V-shaped profile. This can be attained by rotation of both ski halves about a special axis extending at a respective angle to the direction of elongation of the ski and the direction of feeding of the ski.

As has been shown by emperiments, the grinding can be performed in the best way in accordance with the principle of opposed milling so that the relative movement of the individual grinding grains of the grinding wheel relative to the sliding surface of the ski, as long as the grinding grain engages with the material of the sliding surface, should be in direction from the surface obtained by grinding to the not ground surface.

The grinding is advantageously performed, in correspondence with the desired teeth structure, from the ski tip to the ski rear end. It has been unexpectedly shown that the desired structure can be obtained during such grinding only in the event when the grinding speed is substantailly equal to 800 m/min or less. When the grinding speed is equal to substantially 850 m/min or more, the grinding must be performed in direction from the rear end of the ski toward the ski tip. This unexpectedly required reverse of the feeding movement takes place in the event of the above-mentioned working condition in the sense of pressure, circumferential speed, and feeding.

The grinding is advantageously performed with a ceramically bonded grinding wheel of a porosity from medium to high with open structure, inasmuch as here the danger of obliterating of the wheel is at the smallest level. The above-mentioned structure of the sliding surface in accordance with the present invention cannot be obtained during operation with the obliterated grinding wheel. It has been shown from experience that the grinding in the best way is performed with a grinding disk having the graining of between 20 and 40, advantageously of 30 in accordance with the German standard (DIN 69100).

It has further been shown from practice that when the coarse dry grinding is utilized, it is advantageous to perform light overgrinding in the direction of elongation of the ski from the ski tip to the rear end, preferably by hand. This makes easier the sliding of the ski during sliding forwardly in the beginning. This overgrinding is of particular importance when the dry grinding is performed with a grinding speed in the range between 800 and 900 m/min, inasmuch as in this range the desired orientation of the tooth inclination in rearward direction is no longer attained to a sufficient extent.

It has also been shown that it is advantageous to utilize the high molecular polyethylene with a molecular weight between $1\times10^6$ and $4\times10^6$, advantageously between $2\times10^6$ and $3\times10^6$. When the ski in accordance with the present invention is a so-called cross-country ski, the construction of the sliding surface of the bottom layer is also suitable for downhill skis (utilized in mountainous areas). Especially for a beginner or an old skier, the unnoticeable reduction of the speed during the start is not disturbing, whereas the considerable facilitation of the climbing is of great advantage.

The superiority of the ski in accordance with the present invention, in the sense of its sliding characteristic and pushing-off characteristic, takes place particularly with snow in the region of 273° K. and moreover in condition of lower temperature of substantially 265° K. or lower when the bottom layer can be covered with ice. This can be eliminated by application of liquid paraffin wax on the bottom layer. In condition of wet snow the ski in accordance with the present invention must also be waxed.

The novel features of the invention which are considered as characteristic are set forth in particular in the appended claims. The invention itself, however, both as to its construction and its method of operation, together with additional objects and advantages thereof, will be best understood from the following description of preferred embodiments when read in connection with the accompanying drawing.

BRIEF DESCRIPTION OF THE DRAWING

FIG. 1 is a side view showing a ski in accordance with the present invention;

FIG. 2 is an elevation sectional view of a fragment of the inventive ski, in enlarged scale; and FIG. 3 is a view from below of the fragment shown in FIG. 2.

FIG. 4 is a side view showing a grinding wheel on the bottom layer of the ski.

DESCRIPTION OF THE PREFERRED EMBODIMENTS

A cross-country ski in accordance with the present invention is shown in FIG. 1 and has a body part 1 with a bottom layer 2 of high molecular polyethylene with a molecular weight of approximately $2\times10^6$.

The outer surface or the sliding surface of the bottom layer 2, with which the latter slides over the snow, is provided with a plurality of teeth 3 which are produced by grinding and inclined toward the rear end of the ski, and which are arranged in overlapping and non-uniform manner. The teeth can be pointed as wolf teeth or splitting teeth, as identified for example by reference *3a*. The teeth can be provided with a cutting edge having prongs, such as identified for example by reference *3b*. An intermediate shape is also possible, as identified by reference *3c*. The teeth can be provided at their tips or cutting edges with small fuzz 4 (fringe) produced during the grinding, as can be seen from FIG. 2. This fuzz is not shown in FIG. 3 in order to better illustrate the shape of the teeth.

The showing of the teeth on the sliding surface of the bottom layer 2 in FIGS. 2 and 3 is naturally very simplified. For example, the distances between the teeth in the sectional plane of FIG. 2 in direction of elongation of the ski can be less uniform than those shown.

It can be recognized from FIG. 2 that the strong rearward inclination of the individual teeth which, because of their very small dimensions, are bendable and adapt very easily to the snow surface, provides for a very small friction resistance during the forward sliding of the ski. When the ski during pushing-off or climbing tends to move rearwardly, the teeth 3 spread and raise by a certain magnitude so as to engage into the snow surface. The ski shown in FIGS. 1–3 is manufactured in the following manner: The body part of the ski is first manufactured in conventional manner and then provided with a bottom layer of the high molecular polyethylene, usually a low-pressure polyethylene. After the finishing of the outer surface of the ski and the ski flanks, the sliding surface of the bottom layer is ground two times one after the other with a grinding wheel 5 having the graininess 30 and constituted of common or semiprecious corundum. The grinding wheel has a medium to high porosity and is ceramically bonded. It is dressed with a sharp (not worn out) diamond with one tip, the diamond being fed with a speed of substantially between 320 and 330 mm per minute to the respective surface of the rotating grinding wheel. The grinding wheel has a width which is greater than the width of the ski. The ski has a conventional width. The grinding wheel rotates with a number of revolutions in the region of between 500 and 800 per minute and has a diameter of 350 mm. The ski is moved with its tip onto the grinding disk. The sliding surface of the bottom layer of the ski is pressed during the first grinding step with a force of substantially 200 N against the peripheral surface of the grinding wheel. During the second grinding step, the sliding surface of the bottom layer is pressed against the peripheral surface of the grinding wheel with a force of substantially 50 N. The direction of rotation of the grinding wheel is such that the surface region of the grinding wheel which is in engagement with the bottom layer moves relative to the ski with a respectively great speed in direction toward the rear end of the ski as shown in FIG. 4. When the grinding is performed in direction from the rear end of the ski to the ski tip, the speed of rotation for the same grinding wheel diameter is advantageously 850 revolutions per minute or more. When the diameter of the grinding wheel is different, the speed of rotation must be adjusted accordingly. The grinding during both grinding steps is performed in completely dry condition. The sliding surface of the bottom layer is roughened by a depth of approximately 0.08 mm, and the thus obtained roughening is composed of teeth which are shown in FIGS. 2 and 3 and provided with cutting edges or tips as well as with fuzz extending from the teeth flanks. The teeth of course do not yet have the construction which strictly corresponds to the construction shown in FIGS. 2 and 3. They are more non-uniform than those shown in the drawing. In order to obtain the inclination of all teeth produced during the dry grinding, toward the rear end of the ski in a relatively uniform manner, a third grinding step is performed by hand with small pressure and a grinding paper with a grain in the order of value of 200. In some cases the process can be completed by application of liquid wax with paraffin base. The thus produced teeth have a shark-tooth-like or a wolf-tooth-like shape.

The finished grinding considerably increases the speed of the ski during sliding fowardly, without reducing the braking action during pushing-off of the ski, and makes superfluous a running-in (improvement of the sliding characteristic during use of the ski).

Also the roughening of the sliding surface of the bottom layer is provided over the entire bottom layer with the exception of the guiding groove (if it is available). It is also possible to remain at the front end of the ski a region which is somewhat greater than the tip region, and at the rear end of the ski a short piece of the ski length smooth without the roughening. The skier also has a possibility to increase the teeth structure by introducing paraffin at desired locations so as to provide for a correspondence of the sliding and climbing characteristics of the ski to special conditions.

It will be understood that each of the elements described above, or two or more together, may also find a useful application in other types of constructions differing from the types described above.

While the invention has been illustrated and described as embodied in a ski having a body part and a polyethylene bottom layer with roughening, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A ski, comprising an elongated body part having a predetermined supporting length and a rear end; a high-molecular polyethylene bottom layer arranged on said body part; and a roughening provided on said layer and having a thickness substantially equal to $10^{-1}$ mm, said roughening including a plurality of elongated narrowing bendable projections inclined in their entirety toward the rear end of the body part, each formed as a cutting edge-like tooth from the high-molecular polyethylene of said layer, having a length considerably greater than their thickness, arranged with a density of more than 1000 projections per $cm^2$ and overlapping one another to avoid sliding of the ski on free surface regions between said teeth, so that climbing with the ski is facilitated and at the same time sliding capacity thereof is only insignificantly reduced.

2. A ski as defined in claim 1, wherein each of said teeth has a portion which is fuzzed.

3. A ski as defined in claim 1, wherein each of said teeth has a portion which is frayed.

4. A ski as defined in claim 1, wherein each of said teeth has an average length substantially equal to between 0.08 and 0.15 mm.

5. A ski as defined in claim 1, wherein said layer has a sliding surface extending in a predetermined plane, each of said teeth having a mean inclination relative to said sliding surface substantially equal to between 20° and 50°.

6. A ski as defined in claim 1, wherein said teeth cover said layer in its entirety.

7. A ski as defined in claim 1, wherein said polyethylene has a molecular weight equal to between $10^6$ and $4\times10^6$.

8. A method of manufacturing a ski, comprising the steps of providing an elongated body part having a predetermined supporting length, a plane of symmetry and a rear end; arranging on said body part a high-molecular polyethylene bottom layer; and forming on said layer a roughening for facilitating climbing with the ski and at the same time only insignificantly reducing the sliding capability thereof, said forming step including grinding said layer so that said roughening has a thickness substantially equal to $10^{-1}$ mm and includes a plurality of elongated narrowing bendable projections inclined in its entirety toward the rear end of the body part, each formed as a cutting edge-like elongated tooth from the high-molecular polyethylene of said layer, having a length considerably greater than their thickness, arranged with the density of more than 100 per $cm^2$ and overlapping one another that sliding of the ski on free surface regions between said teeth is avoided, said grinding step including dry grinding said layer with a releatively coarse grinding wheel so as to provide a grinding finish which is symmetrical relative to the plane of symmetry and with a sufficiently high efficiency so as to reach a crystallite melt region.

9. A method as defined in claim 8, wherein said grinding step includes grinding with a pressure of a grinding wheel relative to the layer, equal to between 1 and 6 bar.

10. A method as defined in claim 8, wherein said grinding step includes grinding with a grinding speed of between 300 and 2000 m/min.

11. A method as defined in claim 8, wherein said grinding step includes feeding of the ski with a speed of between 2 and 8 m/min.

12. A method as defined in claim 8, wherein said grinding step includes grinding with a predetermined pressure of a grinding wheel, a predetermined grinding speed of the grinding wheel, and a predetermined feeding speed of the ski which are determined relative to one another so that a material removal of between 0.05 and 0.1 mm takes place between the teeth remaining after the grinding.

13. A method as defined in claim 8, wherein said grinding step includes grinding in direction of elongation of said body portion.

14. A method as defined in claim 8, wherein said grinding step includes grinding in accordance with the principle of opposed milling.

15. A method as defined in claim 8, wherein the body part has a tip opposite to the rear end, said grinding step including grinding in direction from the tip toward the rear end with a speed which substantially does not exceed 800 m/min.

16. A method as defined in claim 8, wherein said body part has a tip opposite to the rear end, said grinding step including grinding in direction from the rear end toward the tip with a grinding speed which is not smaller than 850 m/min.

17. A method as defined in claim 8, wherein said grinding step includes grinding with a ceramically bonded grinding disk of a medium porosity and a graininess equal to between 20 and 40.

18. A method as defined in claim 8, wherein said grinding step includes grinding with a semiprecious corundum grinding wheel of a medium porosity and a graininess of between 20 and 40.

19. A method as defined in claim 8; and further comprising the step of light overgrinding performed after said step of grinding, with a relatively coarse grinding wheel and in a reverse from a ski tip to a ski end, with a relatively small pressure of an overgrinding tool as compared with a grinding wheel.

* * * * *